US007259720B2

(12) United States Patent
Ryu

(10) Patent No.: US 7,259,720 B2
(45) **Date of Patent: *Aug. 21, 2007**

(54) INTERNAL ANTENNA FOR A MOBILE HANDSET

(75) Inventor: Ji Woong Ryu, Seoul (KR)

(73) Assignee: Pantech Co., Ltd, Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 11/251,170

(22) Filed: Oct. 14, 2005

(65) Prior Publication Data

US 2006/0033668 A1 Feb. 16, 2006

Related U.S. Application Data

(63) Continuation of application No. 10/810,367, filed on Mar. 26, 2004, now Pat. No. 6,995,717.

(30) Foreign Application Priority Data

Nov. 20, 2003 (KR) ..... 10-2003-0082706

(51) Int. Cl.
*H01Q 1/38* (2006.01)
*H01Q 1/24* (2006.01)

(52) U.S. Cl. ..... 343/700 MS; 343/702

(58) Field of Classification Search ..... 343/700 MS, 343/702, 741, 866, 895, 846
See application file for complete search history.

(56) References Cited

U.S. PATENT DOCUMENTS 6,111,545 A 8/2000 Saari ..... 343/702
6,448,932 B1 9/2002 Stoiljkovic et al. ..... 343/700
6,476,769 B1 11/2002 Lehtola ..... 343/702
6,498,586 B2 12/2002 Pankinaho ..... 343/700
6,552,686 B2 4/2003 Ollikainen et al. ..... 343/700
6,618,011 B2 9/2003 Eggleston et al. ..... 343/700
6,680,705 B2 1/2004 Tan et al. ..... 343/702
6,831,607 B2 12/2004 Hebron et al. ..... 343/700
6,867,746 B2 3/2005 Mendolia et al. ..... 343/841
6,995,717 B2 * 2/2006 Ryu ..... 343/702
2002/0080076 A1 6/2002 Kamei et al. ..... 343/700

FOREIGN PATENT DOCUMENTS

JP 10209732 8/1998
KR 2002-0026361 4/2002

(Continued)

*Primary Examiner*—Michael C. Wilmer
(74) *Attorney, Agent, or Firm*—Ohlandt, Greeley, Ruggiero & Perle L.L.P.

(57) ABSTRACT

The present invention relates to an internal antenna for a mobile handset comprising: a feeding pin for power supply; an upper radiating patch connected to the feeding pin, having a first upper patch portion and a second upper patch portion, which receive power supply from the feeding pin and resonate at different frequency bands respectively; a side radiating patch receiving power supply from the feeding pin, extended along the side of the upper radiating patch and vertically apart from the upper radiating patch by certain distance; and a short pin, one end of which is in contact with the upper radiating patch and the side radiating patch and the other end of which is grounded. According to the present invention, a bandwidth to be used can be broadened without increasing space for a general small size dual band Planar Inverted F Antenna PIFA.

16 Claims, 3 Drawing Sheets

FOREIGN PATENT DOCUMENTS

| | | |
|---|---|---|
| KR | 2003-0003647 | 1/2003 |
| KR | 2003-0046049 | 6/2003 |
| KR | 2003-0053526 | 6/2003 |
| WO | WO98/49742 | 11/1998 |
| WO | WO 01/11721 A1 | 2/2001 |
| WO | WO 02/50948 A1 | 6/2002 |

* cited by examiner (the Related Art)

(the Related Art)

INTERNAL ANTENNA FOR A MOBILE HANDSET

CROSS-REFERENCE TO RELATED APPLICATION

This is a continuation of application Ser. No. 10/810,367, now U.S. Pat. No. 6,995,717, that was filed on Mar. 26, 2004 claiming the priority of the Korean Patent Application No. 10-2003-0082706 filed on Nov. 20, 2003.

BACKGROUND OF THE INVENTION

1. Field of the Invention

The present invention relates to an internal antenna for a mobile handset and, particularly, to a planar inverted F antenna (PIFA), which is a type of the internal antenna for a mobile handset. By using the internal antenna of a mobile handset according to the present invention, the broad bandwidth can be obtained without increasing space for inclusion of a general small-size dual band PIFA.

2. Prior Art

As there is great increase in the use of mobile handsets, researches are conducted actively on antennas for the purpose of raising reception sensitivity of wireless signals. Ordinarily, a PIFA has acceptable characteristics in terms of the Specific Absorption Rate (SAR), a standard to measure damage of microwave to human body, and is easy to be included in a light, thin, simple and small mobile unit. Thus, such PIFA is generally used in a mobile handset.

FIG. 1 illustrates a PIFA. As shown in FIG. 1, the PIFA has structure where a radiating patch 1 is attached to a short pin 3 protruded on a ground plate (GND) and a feeding pin 5 is connected to the radiating patch 1. The radiating patch 1 receives power supply through the feeding pin 5 and is short-circuited with the GND by the short pin 3, thus accomplishing impedance matching. Accordingly, given relevant operating frequencies, the PIFA is designed by adjusting a length L of a patch and a height H of the antenna according to a width Wp of a short pin 3 and a width W of the patch.

In such PIEA, of the entire beam generated by a current induced in the radiating patch, beam directed to the GND is re-induced and the beam directed to the human body is attenuated. Thus, SAR characteristics are improved and the beam induced to the direction of the radiating patch 1 is strengthened, so that the PIFA has advantages in that the PIFA has desirable directivity and it may decrease a size of the antenna.

On the other hand, as service providers utilize various frequency bands, the PIFA in a dual band antenna type (Hereinafter, dual band PIFA) that may utilize different frequency bands is being developed actively. FIG. 2 illustrates a dual band PIFA.

As shown in FIG. 2, the dual band PIFA is designed such that a radiating patch 10 has the spur line and thus includes a first patch portion 12 and a second patch portion 14, that have different lengths and widths. The first patch portion 12 and the second patch portion 14 are fixed to a short pin 3 which grounds the radiating patch 10 and receive power supply from a feeding pin 5.

Even though the first patch portion 12 and the second patch portion 14 make up the same radiating patch 10, they are distinguished into two different radiating patch domains and resonate at different frequency bands. Thus, the first patch portion 12 and the second patch portion 14 may operate at two different frequency bands. Here, the relevant frequency bands at which the respective patch portions 12, 14 operate may be changed by adjusting the respective lengths L1, L2 of the patch portions.

In these conventional PIFAs, however, the relevant bandwidths used by such PIFAs are generally narrow and thus the conventional PIFAs are not adequate for the use in the personal communication service (PCS) or cellular frequency band, for which the demand is increasing daily. Further, if the lengths of patch portions (e.g., L1, L2) are increased in order to broaden the bandwidth, the antenna would become too large to be included inside of a mobile handset.

SUMMARY OF THE INVENTION

The object of the present invention is to provide an internal antenna for a mobile handset, which may ensure broad bandwidth of operating frequency without increasing space for inclusion of a general small-size dual band PIFA.

In order to achieve the object of the present invention, there is provided an internal antenna for a mobile handset, including: a feeding pin for power supply; an upper radiating patch connected to the feeding pin, having a first upper patch portion and a second upper patch portion, which receive power supply from the feeding pin and resonate at different frequency bands respectively; a side radiating patch receiving power supply from the feeding pin, extended along the side of the upper radiating patch and vertically apart from the upper radiating patch by certain distance; and a short pin, one end of which is in contact with the upper radiating patch and the side radiating patch and the other end of which is grounded.

Preferably, the side radiating patch may include: a first side patch portion for resonating at a same frequency band as the first upper patch portion; and a second side patch portion for resonating at a same frequency band as the second upper patch portion.

Preferably, at least one of the first upper patch portion and the second upper patch portion may be formed to have a shape of a meander line.

Preferably, the side radiating patch may have a form of a stick and have a shape corresponding to an outer line of the upper radiating patch.

Preferably, the first upper patch portion and the first side patch portion may resonate at different frequencies respectively.

Preferably, the second upper patch portion and the second side patch portion may resonate at different frequencies respectively.

Preferably, impedance of the first upper patch portion, the second upper patch portion, the first side patch portion and the second side patch portion may change according to a location of a feeding point.

Preferably, impedance of the first upper patch portion, the second upper patch portion, the first side patch portion and the second side patch portion may change according to a width of the short pin.

Preferably, operating frequencies of the first upper patch portion, the second upper patch portion, the first side patch portion and the second side patch portion may change respectively according to lengths of the first upper patch portion, the second upper patch portion, the first side patch portion and the second side patch portion.

Preferably, lengths of the first upper patch portion, the second upper patch portion, the first side patch portion and the second side patch portion may be respectively equal to a quarter wavelength of their own operating frequencies.

Figure 1:
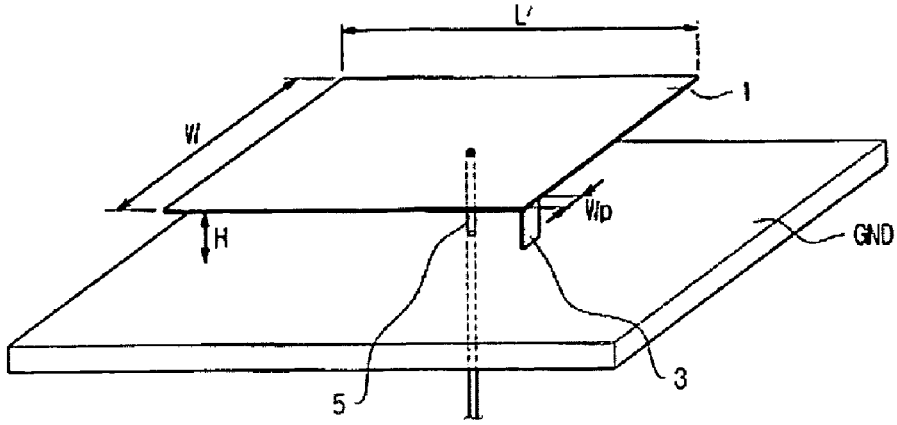
FIG. 1 illustrates a PIFA in the related art.
Figure 2:
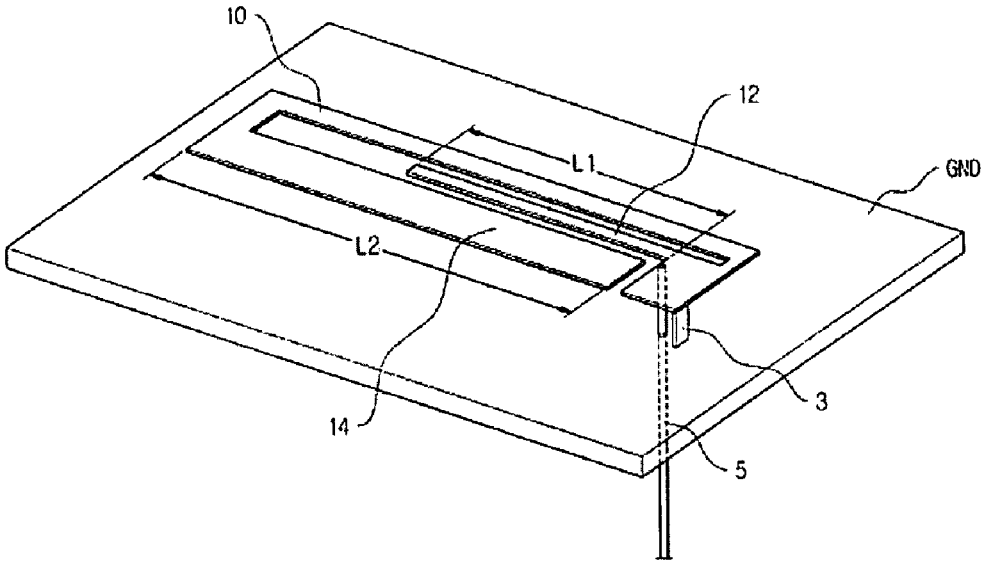
FIG. 2 illustrates a dual band PIFA in the related art.

* * * Descriptions of codes for important parts in the drawings * * *

| | | | |
|---|---|---|---|
| 3: | Short Pin | 5: | Feeding Pin |
| 9: | Feeding Point | 20: | Upper Radiating Patch |
| 22: | First Upper Patch Portion | 24: | Second Upper Patch Portion |
| 30: | Side Radiating Patch | 32: | First Side Patch Portion |
| 34: | Second Side Patch Portion | | |

DETAILED DESCRIPTION OF THE PREFERRED IMPLEMENTATION

Reference will now be made in detail to the internal antenna for a mobile handset according to preferred embodiments of the present invention as illustrated in the accompanying drawings.

Figure 3:
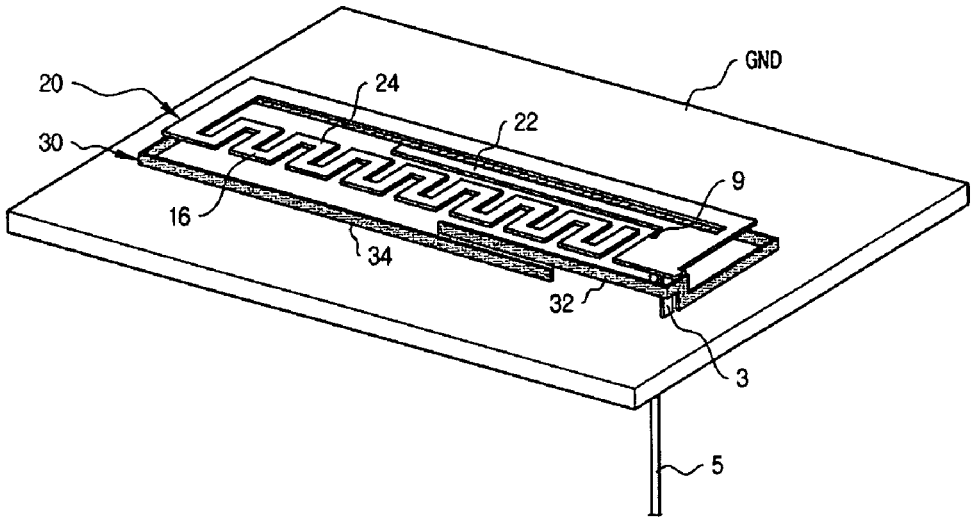
FIG. 3 illustrates an internal antenna for a mobile handset according to the present invention.
Figure 4:
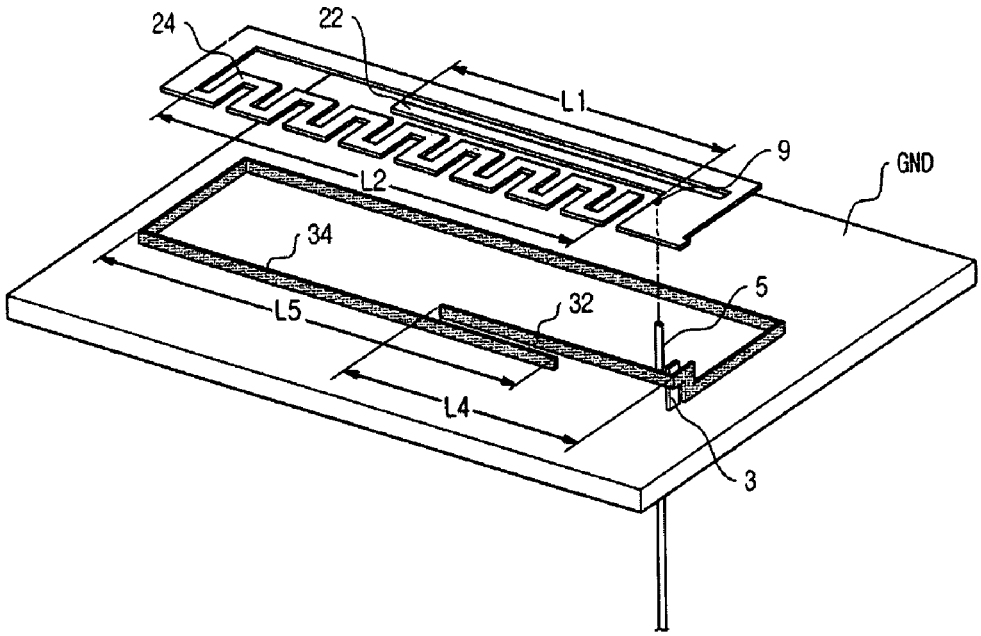
FIG. 4 illustrates the disassembled view of the antenna shown in FIG. 3.

FIG. 3 illustrates an internal antenna for a mobile handset according to the present invention and FIG. 4 illustrates the disassembled view of the antenna shown in FIG. 3.

As shown in FIG. 3, the internal antenna according to the present invention is a PIFA having a dual band and has a three-dimensional structure including an upper radiating patch 20 and a side radiating patch 30.

The upper radiating patch 20 includes a first upper patch portion 22 and a second upper patch portion 24 that resonate at different frequency bands. A first side patch portion 32 and a second side patch portion 34 corresponding respectively to the first upper patch portion 22 and the second upper patch portion 24 are further included, resulting in broadening bandwidth.

Specifically, the upper radiating patch 20 includes the first upper patch portion 22 having a length L1 operable at a PCS frequency band and the second upper patch portion 24 having a length L2 operable at a cellular frequency band. Preferably, lengths of the first upper patch portion 22 and the second upper patch portion 24 are designed to be approximately a quarter wavelength of a relevant frequency band at which the antenna operates, taking into account thickness, width and height of installation of the relevant patch portion.

For example, if the upper radiating patch 20 is designed to have a length 37 mm and an entire width 9 mm and if it is installed to be apart from the GND by 7 mm, the first upper patch portion 22 operating at the PCS frequency band may be designed by adjusting its length L1 and its width within the scope of the upper radiating patch 20, but a length of the second upper patch portion 24 operating at the cellular frequency band must be increased. Accordingly, the second upper patch portion 24 is designed by the meandering method to increase the length through which a current may flow and thus the length of the second upper patch portion L2 may be approximately a quarter wavelength of the cellular frequency band.

As shown in FIG. 4, the side radiating patch 30 included according to the present invention is in the form of a stick having a shape corresponding to an outer line of the upper radiating patch 20 and is attached in the area close to the upper radiating patch 20. The side radiating patch 30 includes a first side patch portion 32 having a length L4 operable at the PCS frequency band and a second side patch portion 34 having a length L5 operable at the cellular frequency band.

Preferably, lengths of the first side patch portion 32 and the second side patch portion 34 are designed to be approximately a quarter wavelength of the relevant frequency band at which the relevant antenna operates, taking into account thickness, width and dielectric constant of the relevant patch and are adjusted to have optimum lengths through simulations.

Each side patch portion 32, 34 is coupled with the corresponding upper patch portion 22, 24. The first upper patch portion 22 and the first side patch portion 32 operate at the PCS frequency band of from 1750 MHz to 1870 MHz. The second upper patch portion 24 and the second side patch portion 34 operate at the cellular frequency band of from 824 MHz to 894 MHz.

Here, the upper patch portion and the corresponding side patch portion operate at the same frequency band but do not operate at the same specific frequencies. They operate at adjacent different frequencies respectively within the same frequency band. For example, if the second upper patch portion 24 operating within the frequency band of 824 MHz to 894 MHz resonates at the frequencies around 850 MHz, the corresponding second side patch portion 34 is designed to resonate at the frequencies around 870 MHz, thus broadening bandwidth used for receipt of cellular frequencies.

In the antenna according to the present invention, if power is supplied to the upper radiating patch 20 and the side radiating patch 30 through the feeding point 9 connected to the feeding pin 5, they are short-circuited with the GND by the short pin 3, accomplishing impedance matching.

Further, impedance of each patch portion 22, 24, 32, 34 may be changed by changing a location of the feeding point and by adjusting a width of the short pin. The operating frequencies of each patch portion 22, 24, 32, 34 may be changed by adjusting lengths of the relevant patch portion L1, L2, L4, L5. Thus, at the time of designing the antenna, it is preferable to find out optimum lengths of the patch portion L1, L2, L4, L5 through simulations of operating frequency characteristics as the relevant length of the patch is changed.

Figure 5:
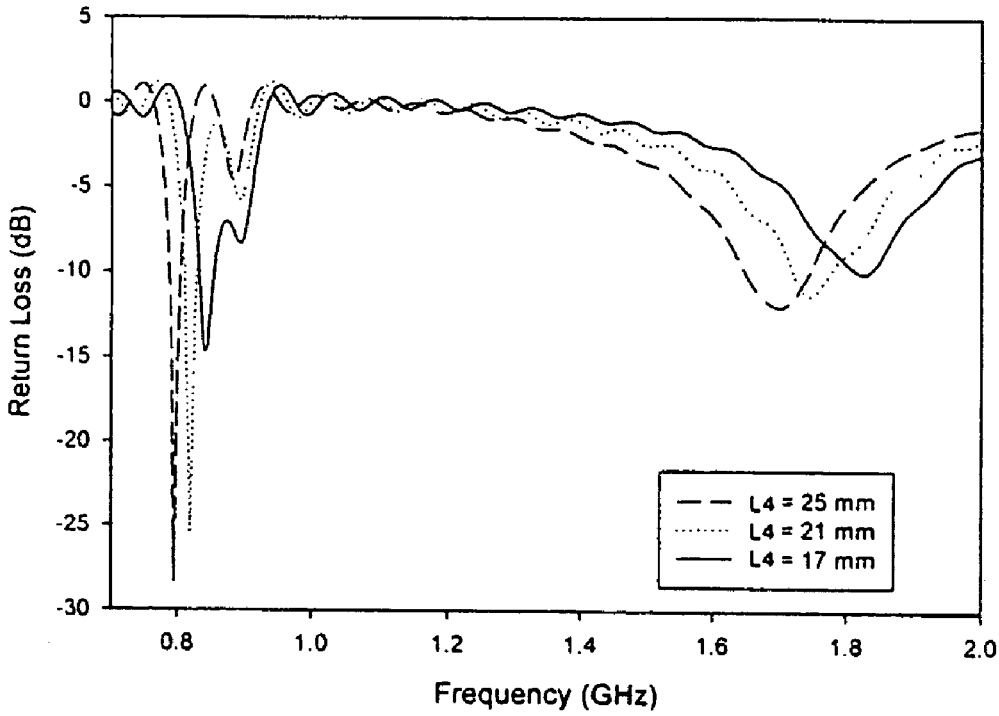
FIG. 5 is the graph showing the simulation result of operating frequencies according to changes in the length (L4) of the first side patch portion shown in FIG. 4.
Figure 6:
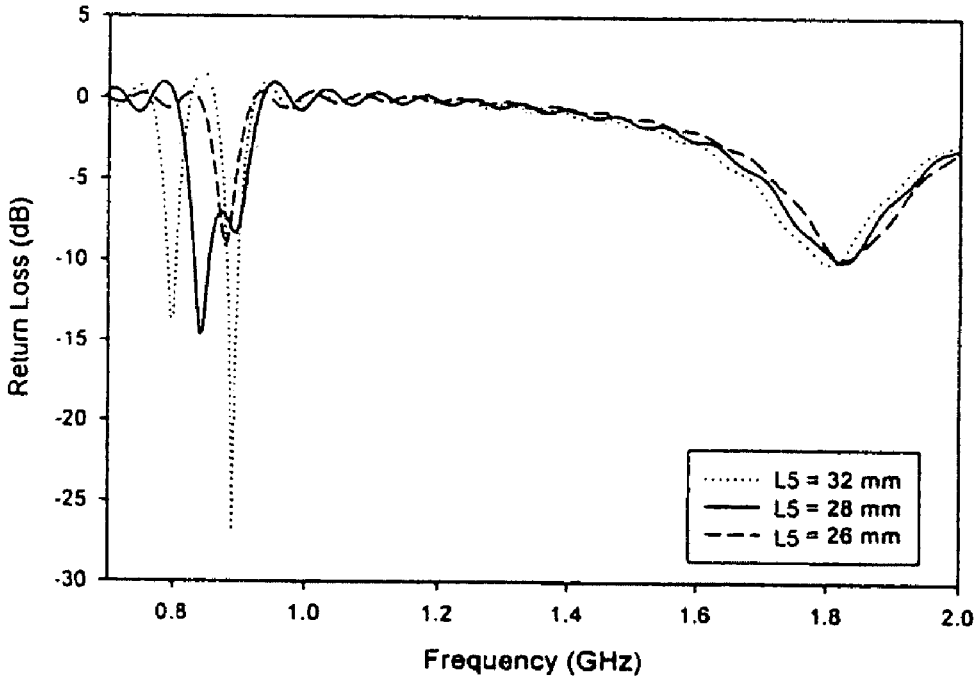
FIG. 6 is the graph showing the simulation result of the operating frequencies according to changes in the length (L5) of the second side patch portion shown in FIG. 4.

FIG. 5 and FIG. 6 are graphs showing simulation results on changes of operating frequencies according to lengths of the first side patch portion 32 and the second side patch portion 34.

FIG. 5 illustrates the simulation result on changes of the operating frequency when a length of the first side patch portion 32 (L4) is adjusted. As shown in FIG. 5, the operating frequencies for PCS change as L4 changes.

FIG. 6 illustrates the simulation result on changes of the operating frequency when a length of the second side patch portion 34 (L5) is adjusted. As shown in FIG. 6, if L5 is 32 mm, the second upper patch portion 24 and the second side patch portion 34 respectively resonate independently within the cellular band. If L5 is 28 mm, the resonant frequencies of the second upper patch portion 24 and the second side patch portion 34 coincide partially. Thus, bandwidth of operating frequencies is broadened. This broadened bandwidth satisfies the bandwidth of a general commercial cellular frequencies of approximately 70 MHz bandwidth (824 MHz-894 MHz).

However, as shown in FIG. 5, minor frequency changes occur in the cellular frequency band as L4 changes, so that the combined two resonance characteristics are not completely concomitant at the same frequency.

Given the foregoing, the internal antenna according to the present invention may be designed to have the broad bandwidth if L4 is adjusted first and then L5 is adjusted. Further, in the PCS frequency band, as the resonant frequencies of the first upper patch portion 22 and the first side patch portion 32 are combined to broaden the relevant bandwidth by approximately 140 MHz and thus may satisfy the bandwidth of a general commercial PCS frequencies (1750 MHz-1870 MHz).

As described above, according to the present invention, the side radiating patch is added to the PIFA having the dual band and operates together with the upper radiating patch. Accordingly, the present invention may broaden bandwidth of the operating frequency without increasing space for installing a general small-size dual band PIFA.

The foregoing embodiments are merely exemplary and are not to be construed as limiting the present invention. Many alternatives, modifications and variations will be apparent to those skilled in the art.

What is claimed is:

1. A mobile handset having an antenna, wherein said antenna comprises:

a feeding pin for power supply;

an upper radiating patch connected to the feeding pin, having a first upper patch portion and a second upper patch portion, which receive power supply from the feeding pin and resonate at different frequency bands respectively;

a side radiating patch receiving power supply from the feeding pin, extended along the side of the upper radiating patch, wherein at least a portion of the side radiating patch is formed to be diagonal to the upper radiating patch; and a short pin, one end of which is in contact with the upper radiating patch and the side radiating patch and the other end of which is grounded.

2. A mobile handset of claim 1, wherein at least a portion of the side radiating patch is formed to be horizontal to the upper radiating patch.

3. A mobile handset of claim 1, wherein at least a portion of the side radiating patch aparts from the upper radiating patch in parallel.

4. A mobile handset of claim 1, wherein the side radiating patch comprises:

a first side patch portion for resonating at a same frequency band as the first upper patch portion; and a second side patch portion for resonating at a same frequency band as the second upper patch portion.

5. A mobile handset of claim 1, wherein at least one of the first upper patch portion and the second upper patch portion is formed to have a shape of a meander line.

6. A mobile handset of claim 1, wherein the side radiating patch has a shape corresponding to an outer line of the upper radiating patch.

7. A mobile handset of claim 4, wherein the first upper patch portion and the first side patch portion resonate at different frequencies respectively.

8. A mobile handset of claim 4, wherein the second upper patch portion and the second side patch portion resonate at different frequencies respectively.

9. A mobile handset of claim 4, wherein impedance of the first upper patch portion, the second upper patch portion, the first side patch portion and the second side patch portion change according to a location of a feeding point.

10. A mobile handset of claim 4, wherein impedance of the first upper patch portion, the second upper patch portion, the first side patch portion and the second side patch portion change according to a width of the short pin.

11. A mobile handset of claim 4, wherein operating frequencies of the first upper patch portion, the second upper patch portion, the first side patch portion and the second side patch portion change respectively according to lengths of the first upper patch portion, the second upper patch portion, the first side patch portion and the second side patch portion.

12. A mobile handset of claim 4, wherein a length of the first upper patch portion is equal to a quarter wavelength of its own operating frequency.

13. A mobile handset of claim 4, wherein a length of the second upper patch portion is equal to a quarter wavelength of its own operating frequency.

14. A mobile handset of claim 4, wherein a length of the first side patch portion is equal to a quarter wavelength of its own operating frequency.

15. A mobile handset of claim 4, wherein a length of the second side patch portion is equal to a quarter wavelength of its own operating frequency.

16. A mobile handset having an antenna, wherein said antenna comprises:

a feeding pin for power supply;

an upper radiating patch connected to the feeding pin, having a first upper patch portion and a second upper patch portion, which receive power supply from the feeding pin and resonate at different frequency bands respectively;

a side radiating patch receiving power supply from the feeding pin, extended along the side of the upper radiating patch, wherein at least a portion of the side radiating patch is formed to be vertical to the upper radiating patch; and a short pin, one end of which is in contact with the upper radiating patch and the side radiating patch and the other end of which is grounded.

* * * * *